US005259204A

United States Patent [19]

McKeown

[11] Patent Number: 5,259,204

[45] Date of Patent: Nov. 9, 1993

[54] REFRIGERANT RELEASE PREVENTION SYSTEM

[76] Inventor: Dennis McKeown, 11455 Summer Ln., N. Biloxi, Miss. 39532

[21] Appl. No.: 2,176

[22] Filed: Jan. 8, 1993

[51] Int. Cl.[5] ..... F25B 41/00

[52] U.S. Cl. ..... 62/174; 62/475; 62/DIG. 17

[58] Field of Search ..... 62/149, 174, 324.4, 62/DIG. 17

[56] References Cited

U.S. PATENT DOCUMENTS 3,237,422 3/1966 Pugh ..... 62/174

3,736,763 6/1973 Garland ..... 62/174

*Primary Examiner*—John M. Sollecito

*Attorney, Agent, or Firm*—Alexander F. Norcross

[57] ABSTRACT

A system for diverting refrigerant into an auxiliary receiving vessel to reduce refrigerator system pressure during an incipient over-pressure condition to prevent activation of safety pressure relief valves and release of refrigerant into the atmosphere.

6 Claims, 2 Drawing Sheets

REFRIGERANT RELEASE PREVENTION SYSTEM

BACKGROUND OF THE INVENTION

This invention relates to the field of mechanical refrigeration units using halogen containing compounds, especially Freon and its derivatives. Freon and its related compounds are known and widely used as heat transfer media in mechanical refrigeration apparatus, including units intended for unattended operation such as truck and trailer mounted units. Such units usually include a refrigerant receiving tank, a pressure vessel for storage of liquid refrigerant, which also may include means for assisting in the condensation of gaseous refrigerant to a liquid state; an evaporator converting the refrigerant into a cold gas, which provides the cooling effect; a condenser for converting the hot gaseous refrigerant into a cooler liquid form, and a compressor which establishes a refrigerant pressure differential around the system, causing refrigerant flow . Since the units include pressurized storage of an evaporative liquid, safety codes require that each system have pressure relief valves, which release refrigerant if internal system pressure rises above a certain level.

More recently, it has become known that release of chlorinated hydrocarbons into the atmosphere is a significant environmental danger. Since typical trailer borne refrigeration systems contain approximately 13 pounds (liquid) of such refrigerants, pressure relief can result in a significant release of such refrigerant.

No system is known to the applicant for capture or prevention of release of refrigerants when an over-pressure situation occurs or a pressure relief valve opens. U.S. Pat. No. 2,682,752 to Branson shows, in the field of petroleum storage, a system in which pressure reacting switches divert vapor from a system to an overflow tank. U.S. Pat. No. 3,736,763 discloses the use of pressure responsive switches to control the flow of fluids in a refrigeration system.

SUMMARY OF THE INVENTION

This invention is of a system for diverting refrigeration into an auxiliary receiving vessel to reduce system pressure during an incipient over-pressure condition to prevent activation of safety pressure relief valves and release of refrigerant into the atmosphere.

The system is added to a typical mechanical refrigeration unit, of the type intended for extensive unattended use. A typical example is a trailer or shipping container mounted refrigeration unit of the type used for shipment of food or perishable commodities. Such units operate continuously, without monitoring or surveillance. In ship movement of containers, it will be found after each voyage that one or more containers has vented a significant amount of refrigerant overboard due to over-pressure. This poses an environmental threat, as well as risking damage to the refrigeration system and container contents due to continued operation of the machinery without adequate refrigerant.

It is found that such mechanical refrigeration units can be classified into two general types, depending on the location of the pressure relief valves. The first type locates the pressure relief valves in the liquid side of the refrigeration cycle; dumping of liquid refrigerant is the most effective method of reducing system pressure. In this type the valve may be installed as an over-pressure dump in a liquid line, which theoretically only dumps sufficient refrigerant to lower pressure. Alternately, the valve is a "soft plug", usually installed in the primary pressure vessel, which blows out, dumping all system refrigerant.

The second type provides the pressure relief in the hot gas side of the refrigeration system. While this is usually the highest pressure side of the system, gas release does not usually immediately reduce the over-pressure condition, especially as the usual design of a refrigeration system results in increased flow of refrigerant to the hot gas side as the pressure drops. Therefore a larger quantity of refrigerant must be vented to reduce pressure in this type of system.

The invention adds to the existing system a parallel, secondary receiver tank, connected by a receiving line to a pressure activated dump valve in the line in which the system primary safety valve is located, and connected through a supply line to a pressure activated valve in a low pressure side of the system, usually at the inlet side of the compressor.

The pressure activated dump valve is set to open at a pressure less that the set point of the system's original pressure relief valves, but above any normal system working pressure. Depending on the class of the system, this valve may divert either liquid or gaseous refrigerant into the auxiliary receiving tank. The volume of this tank is such that a significant percentage of the system refrigerant charge can be accepted under such over-pressure conditions; this volume reduction in system refrigerant charge is sufficient to lower system pressure and prevent venting by the system safety pressure reliefs in almost all cases, including all localized temporary over-pressure conditions.

The reduction in refrigerant charge will result in a lowering of system pressure. When the condition which produced the over pressure ceases, this loss of refrigerant charge will result in a drop of pressure at the compressor inlet to a below normal pressure. A pressure sensor monitors refrigerant pressure in the auxiliary receiving tank as a measure of whether refrigerant has been diverted to the auxiliary tank. This sensor generates a signal when the auxiliary tank is pressurized. In response to this signal, the supply line pressure activated valve opens, returning the diverted refrigerant to the system. The difference in pressure resulting from the fact that the fact that refrigerant is always removed form a high pressure point in the system and always returned to a low pressure point, results in a pressure profile across the auxiliary tank which insures that adequate removal capability is available to relieve over-pressure, but the system will not be starved of refrigerant after the cause of the over-pressure is alleviated or under any normal operating condition, as scavenged refrigerant will always flow to the return line to the system.

It is thus an object of the invention to prevent release of refrigerant to the atmosphere in most over-pressure conditions.

It is a further object of the invention to relieve temporary over-pressure conditions in mechanical refrigeration units without venting refrigerant into the atmosphere.

It is a further object of the invention to conserve refrigerant, restoring refrigerant charge levels to systems after alleviation of temporary over-pressure conditions.

These and other objects of the invention may be seen from the detained description of the preferred embodiments given below.

DETAILED DESCRIPTION OF THE INVENTION

Figure 1:
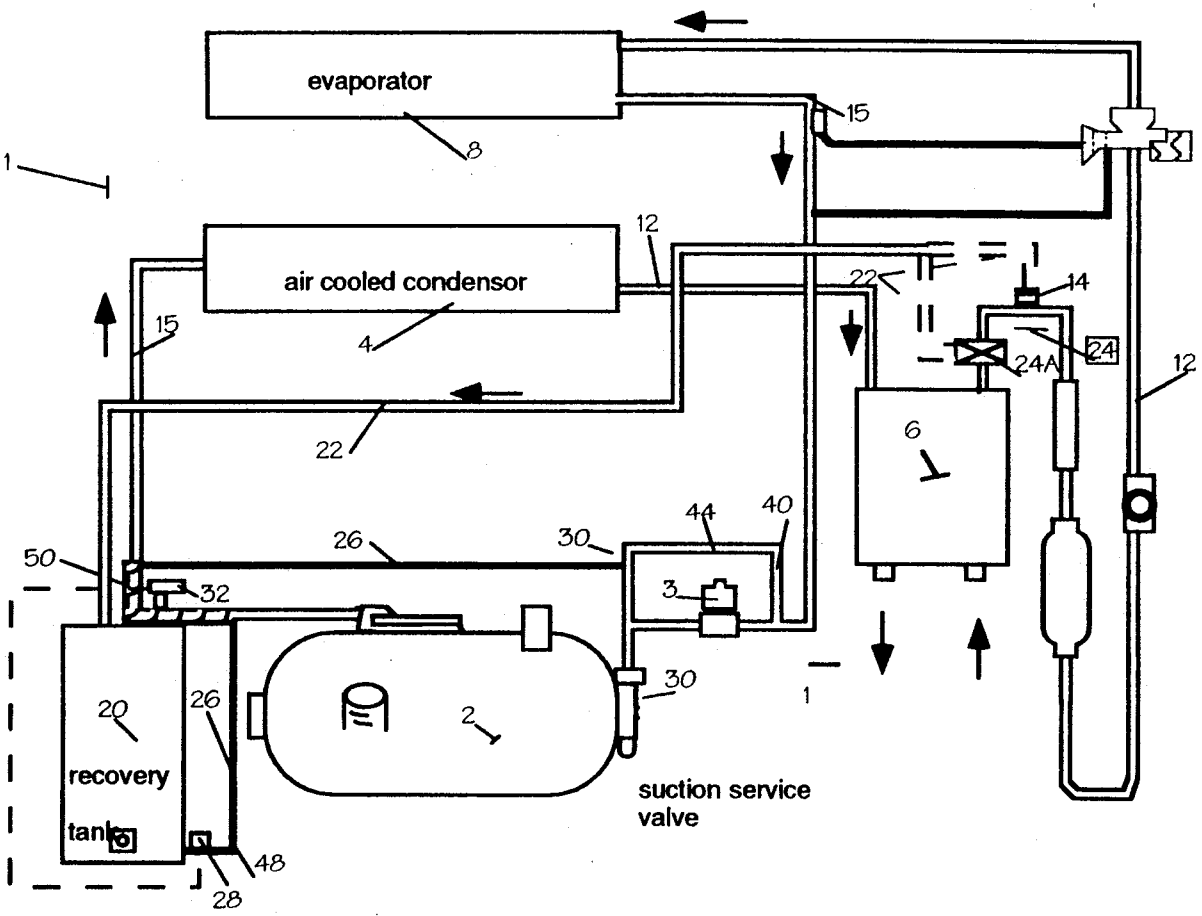
FIG. 1 is a schematic view of a typical installation of the invention.
Figure 2:
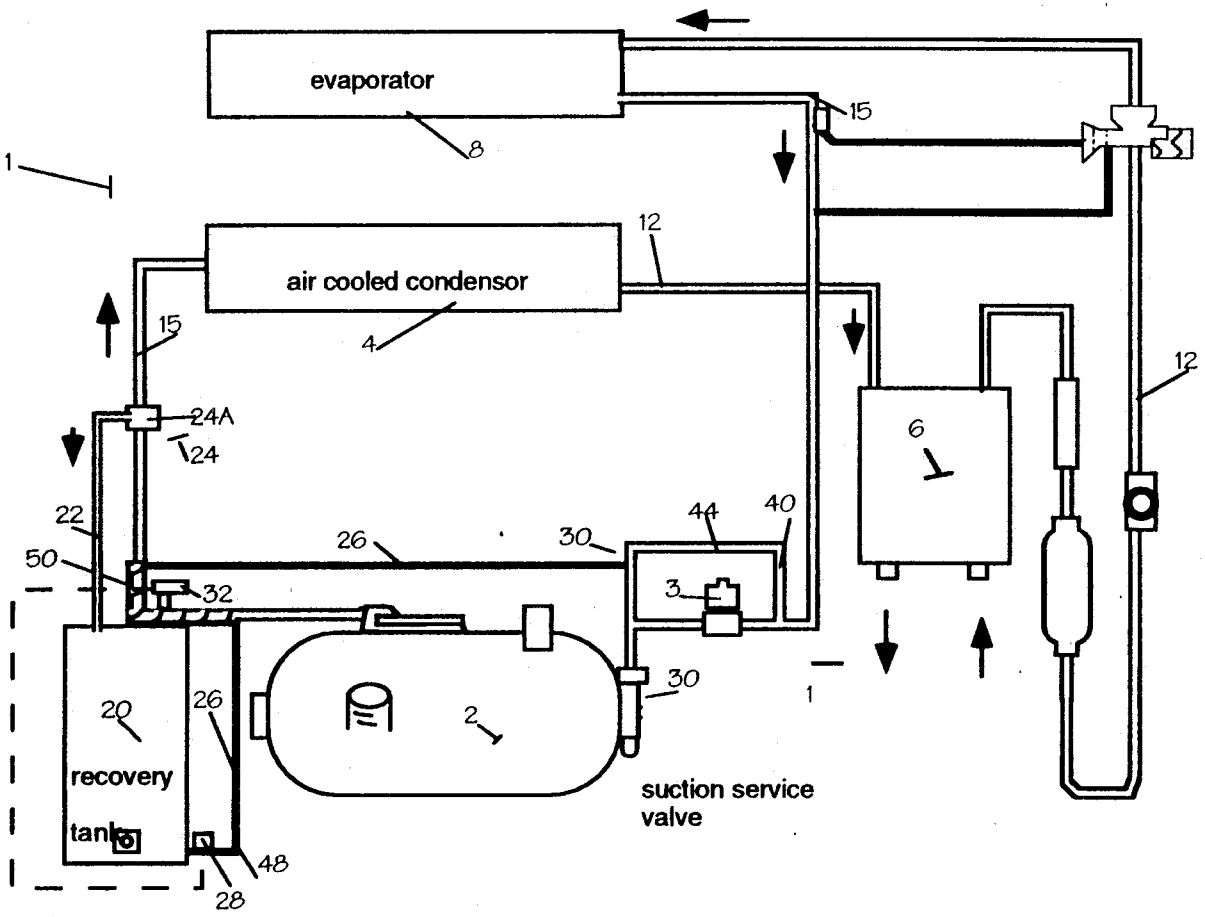
FIG. 2 is a schematic showing an alternate form of the invention.

The invention is shown as a recovery system installed on a standard closed cycle refrigeration system 1. A gaseous refrigerant is compressed by a compressor 2 and then cooled in a condenser 4 to a liquid state. The liquid fills the liquid side piping 12 and may be held in a storage reservoir 6; it flows under system pressure created by the compressor 2, as required for cooling, to an evaporator 8. Evaporation of the refrigerant produces the cooling effect, but results in the return of the refrigerant to a gaseous state. Since the refrigerant flows through the system 1 as a result of a pressure differential created by the compressor 2, it is customary to use a modulator valve 3 to control return flow of refrigerant to the compressor. As the modulator valve 3 cuts off refrigerant flow, the cooling rate of the system 1 is reduced; the modulator valve thus is normally controlled by a system thermostat (not shown) located in the cooled spaces to control the amount of system cooling.

Two points of high pressure danger exist within such a system. First, at any time the bulk of the refrigerant is in liquid form within the system 1 or reservoir 6. If, for any reason, the system 1 is exposed to excessive temperatures, then evaporation of this liquid will cause an increase in pressure; the greatest danger of over pressure failure is to the liquid reservoir 6, and thus the reservoir 6 or its liquid side piping 12 will be equipped with pressure relief devices 14, either as a pressure relief valve 14, or as a blow out plug. The principal difference between these devices is that the relief valve should close and cease venting once the over pressure condition is relieved; a "soft plug" or blow out plug simply dumps the entire refrigerant supply to the atmosphere. It happens however, since in normal use a pressure relief valve 14 never is cycled, that often the pressure relief valve will not properly seat, due to contamination, age or debris, and thus all the refrigerant will escape once the valve activates.

In the invention an auxiliary receiver tank 20 is provided with a volume approximately one-third of the volume of the main system 1. A recovery supply pipe 22 connects this tank to a means 24 for diverting flow of refrigerant from the system 1 during over pressure conditions.

In one embodiment, this means 24 is a supply pipe 22 end installed over, in sealed fluid communication with the outlet of the pressure relief valve 14. As a result, refrigerant vented by the pressure relief valve 14 flows directly into the recovery supply pipe 22 and into the auxiliary receiver tank 20.

It is possible that safety codes would prohibit covering the relief valve 14 in this manner, or the system 1 may be one in which the outlet of the pressure relief is not suitable for connection of a pipe. Such systems would include those in which a blow out plug is installed in the reservoir body 6. In this case a separate secondary diverter valve 24A is installed in the same piping section or tank as the main relief valve 14 or blow out plug. The outlet of this secondary valve 24A is connected by sealed connection to the recovery supply pipe. This secondary relief valve 24A will be set to open at a pressure below the set point of the main relief valve 14, but well above standard system working pressure. Since typically pressure relief valves are set for a pressure of over twice normal working pressure, such a setting is easily determined for any typical refrigeration system.

The recovery supply pipe 22 connects directly to the auxiliary receiver tank 20, and any fluid or gas vented into the recovery supply pipe 22 will flow into the auxiliary receiver tank 20. Since flow to the auxiliary receiver tank 20 will only occur during over pressure conditions, the refrigerant pressure during filing of the auxiliary tank 20 will be well above normal system working pressure, and the tank 20, although of relatively small volume, will therefore receive and hold a significant fraction of the refrigerant from the system 1 as overflow.

The removal of this overflow refrigerant will lower pressure in the main system 1. As soon as the system pressure drops below the set point of the pressure relief valve 14 or the secondary diverter valve 24A, that valve will close, maintaining refrigerant pressure in the auxiliary tank 20 at a higher pressure than system working pressure.

A recovery return pipe 26 connects the auxiliary tank 20 to a pressure recovery valve 28 located for feed of recovered refrigerant to the suction side 30 of the system compressor 2. This connection to the suction side 30 is preferably through a solenoid valve 28, controlled by an electrical control current controlled by a system recovery pressure switch 32. This switch 32 is connected to detect refrigerant pressure in the auxiliary tank 20, as an indication that refrigerant has been diverted due to over pressure. Upon the occurrence of such refrigerant pressure, the recovery solenoid 28 opens, connecting the suction side 30 of the compressor 2, which is the lowest pressure point in the system 1, with the auxiliary receiver tank 20, which has been filled to an over pressure state. This pressure differential rapidly scavenges the recovered refrigerant back into the system 1 through the compressor 2. Since restoration of normal system refrigerant pressure will close the refrigerant diverter means 24, normal system pressures restoration will be sensed by the recovery pressure switch 32 as a drop in refrigerant pressure in the auxiliary tank 20, and the recovery solenoid 28 will close, the diverted refrigerant having been returned to the system, restoring normal operation.

Under normal conditions, the suction side 30 of the compressor 2 will draw down the pressure in the auxiliary receiver tank 20 to the lowest system pressure, recovering substantially all the dumped refrigerant. In any event, all refrigerant is contained within the system 1 or within the recovery system, and no refrigerant is dumped to the atmosphere.

All refrigerator compressors 2 are designed to compress a gaseous refrigerant; all compressors 2 also depend on a continuous flow of refrigerant for lubrication and cooling. Some compressors 2 are sufficiently strong that they can function in the presence of a small percentage of liquid refrigerant, but most systems have valves or expansion orifices in the return piping 40 to prevent liquid being applied to the suction side. Most systems control cooling by a modulator valve 3, which cuts off refrigerant flow to cut off cooling. Since full cutoff of all refrigerant also cuts off all cooling and lubrication to the compressor 2, most systems have a small diameter secondary refrigeration piping and valve 44, sometimes called a quench valve which bypasses a small quantity of refrigerant, and expands it to a gas, to support the compressor 2 whenever the modulator valve 3 cuts off main refrigerant flow.

Depending on the design of the system 1 to which the recovery system of the invention is connected, the pressure relief valve 24 may be in a liquid side 12 of the system or a gas side 15 of the system. If the system is such that the overflow refrigerant is liquid, then it is preferred that the recovery return pipe 26 be connected so as to provide a gaseous refrigerant to the compressor 2. This can be done by passing the recovered refrigerant through a heat exchanger 50 interconnected with the hot gas side 15 line coming from the compressor 2, so as to vaporize the return recovery refrigerant before return to the compressor. Alternately, the return pipe 26 can be a small diameter pipe, for example one-fourth inch diameter, including an expansion orifice 48 in return pipe 26.

A warning light is beneficial to alert maintenance personnel that over pressure has occurred; such a light may be incorporated in recovery pressure switch 32. Recovery switch 32 may also have a manual switch for maintenance personnel to dump the recovery tank to the system.

It can be seen that the system as described is adaptable to many variant refrigeration systems, and in each case, prevents temporary or localized over pressure conditions from dumping refrigerant to the atmosphere, but rather removes refrigerant from the system lowering system pressure to a safe level, and then, when the cause of the over pressure is removed, and system pressure drops, returns the recovered refrigerant to assure continued safe system operation. The invention adds little bulk to the existing system, and requires no sophisticated control system which might fail for its continued operation. The invention is thus especially suitable for shipping container and truck trailer refrigeration systems which must run for extended periods of time as unattended systems.

I claim:

1. An apparatus for preventing the release of refrigerant from a mechanical refrigeration system having piping within which is placed a system safety pressure relief valve having a relief set point, and having a compressor having a suction side, comprising:

an auxiliary receiving tank;

a refrigerant flow line in fluid connection to said tank from a pressure relief valve in the system line having a system relief valve, which conducts flow of refrigerant to said tank upon opening of said pressure relief valve;

a refrigerant flow return line in fluid connection from said tank to a second valve located in a low pressure point in the system; and control means responsive to pressure in said auxiliary tank for opening said second valve

2. The apparatus of claim 1, said pressure relief valve comprising the system pressure relief valve.

3. The apparatus of claim 1 further comprising:

a heat exchanger interconnecting said return line and a hot gas line in the system, adapted to vaporize any liquid refrigerant flowing in said return line.

4. The apparatus of claim 1, said low pressure point comprising the suction line of the compressor.

5. The apparatus of claim 4 further comprising:

an expansion orifice intermediate said second valve and said suction line, adapted to convert a flow of liquid refrigerant into gaseous refrigerant for said compressor.

6. The apparatus of claim 1, said means for opening comprising:

a pressure activated electric switch, adapted to produce an electric signal responsive to the occurrence of a refrigerant pressure in said tank; and an electrically operated valve, responsive to said signal for fluid flow from said return line to said low pressure point.

* * * * *